US007765826B2

(12) United States Patent
Nichols

(10) Patent No.: US 7,765,826 B2
(45) Date of Patent: Aug. 3, 2010

(54) SELECTIVE AUTODISCOVERY SYSTEM

(75) Inventor: Steven C. Nichols, Maple Grove, MN (US)

(73) Assignee: Honeywell International Inc., Morristown, NJ (US)

( * ) Notice: Subject to any disclaimer, the term of this patent is extended or adjusted under 35 U.S.C. 154(b) by 392 days.

(21) Appl. No.: 11/461,625

(22) Filed: Aug. 1, 2006

(65) Prior Publication Data

US 2008/0029610 A1 Feb. 7, 2008

(51) Int. Cl.
*F25D 19/00* (2006.01)

(52) U.S. Cl. ..... 62/298; 62/161; 236/51; 700/276

(58) Field of Classification Search ..... 236/94, 236/51; 700/90, 276, 299, 300; 62/298, 62/161, 163, 164
See application file for complete search history.

(56) References Cited

U.S. PATENT DOCUMENTS

| | | | | |
|---|---|---|---|---|
| 6,112,246 | A | 8/2000 | Horbal et al. | |
| 6,834,298 | B1 | 12/2004 | Singer et al. | |
| 6,834,303 | B1 | 12/2004 | Garg et al. | |
| 2002/0077077 | A1 | 6/2002 | Rezvani et al. | |
| 2003/0097482 | A1* | 5/2003 | DeHart et al. | 709/253 |
| 2005/0040250 | A1* | 2/2005 | Wruck | 236/51 |
| 2006/0016901 | A1* | 1/2006 | Beitelmal et al. | 236/49.3 |

FOREIGN PATENT DOCUMENTS

| | | |
|---|---|---|
| SI | 20556 | 10/2001 |

OTHER PUBLICATIONS

Lennox, "Network Control Panel (NCP), User's Manual," 18 pages, Nov. 1999.
Carrier, "Infinity Control Brochure," Carrier Corporation, 6 pages,, 2005.
Carrier, "Infinity Control Homeowner's Guide," Carrier Corporation, 35 pages, 2004.
Carrier, "Infinity Smart Sensor for Zoning, Installation and Start-Up Instructions," Carrier Corporation, 8 pages, 2004.
Carrier, "SYSTXCCUID01 Infinity Control, Installation and Start-Up Instructions," Carrier Corporation, 12 pages, 2004.
Carrier, "SYSTXCCUIZ01-A Infinity Zone Control, Installation Instructions," Carrier Corporation, 20 pages, 2005.
http://hometoys.com/show_news.php4?section=ehancedview &id=14463768, "Control4 Introduces Comprehensive Portfolio of Home Automation Products," 4 pages, printed May 12, 2006.

(Continued)

*Primary Examiner*—Frantz F. Jules
*Assistant Examiner*—Daniel C Comings
(74) *Attorney, Agent, or Firm*—Crompton Seager & Tufte LLC

(57) ABSTRACT

An autodiscovery system for configuration information about an HVAC system being provided to a controller or thermostat. Configurations or parameters may be autodiscovered from communicating equipment. Also, this equipment may be manually selected and set without affecting the autodiscovery status of the remaining equipment. There may also be non-communicating equipment that does not provide information to the thermostat. However, the thermostat may control the non-communicating equipment via an equipment interface module.

12 Claims, 3 Drawing Sheets

OTHER PUBLICATIONS

Honeywell, "T8635L Microelectronic Communicating Programmable Thermostat," Honeywell International Inc., 20 pages, 2003.
"Introduction to the Lonworks System," Echelon Corporation, 73 pages, 1999.
Viconics, "T7600 Series BACnet Multi-Stage Thermostats With and Without Scheduling Capability," 22 pages, prior to Aug. 1, 2006.
Warmer et al., "Computerised Intelligence in Small Scale Home Networks and Beyond," 92 pages, Nov. 2001.

* cited by examiner

SELECTIVE AUTODISCOVERY SYSTEM

BACKGROUND

The present invention pertains to heating, ventilation and air conditioning (HVAC) systems and particularly to controllers of HVAC systems. More particularly, the invention pertains to controller or thermostat interactions with HVAC systems.

SUMMARY

The present invention is a controller system having selective autodiscovery.

DESCRIPTION

HVAC (heating, ventilation and air conditioning) systems may include about anything that relates to air control, comfort and quality for various spaces. In the related art of non-communicating HVAC systems, an installer may manually configure the thermostat for proper control of the heating, ventilation and cooling equipment. Configuring is indicating to the thermostat the kind of equipment that it is to interface with for effectively good control. For example, a configuration may indicate whether the system equipment includes a heat pump. The configuration may further indicate the number of compressor stages, auxiliary heating stages, emergency heating stages, whether a dual fuel arrangement is used (e.g., both a heat pump and furnace), and the cycling rate used for each stage, among other things. For a non-heat pump version, the configuration description may indicate the number of heating stages, whether the heating equipment is electric or fossil fuel, and it may indicate the cycling rate to use for each stage.

However, with a network in an HVAC system, the heating and cooling equipment may communicate configuration information to the thermostat, thereby automatically configuring the thermostat system without an installer having to manually enter the information about the equipment.

A thermostat or parameter controller may to some extent be a communicating device and capable of automatically discovering a configuration (which might, for example, have a lack of or an exception for cycle rates which could be manually set) of an HVAC system. Previous to the present application, such thermostat had just one mode, either an autodiscovery or manual setup, relative to a component having manual settings to be input. In that system, the installer could override the automatically discovered configuration through an interface on the thermostat for a manual settings input. However, in the system, if any parameter was overwritten with a manual input, the thermostat ceased autodiscovery of any parameters until the installer restarted autodiscovery again, which would autodiscover all of the parameters again, including the manual input of the autodiscovery scheme. In other words, the installer could not selectively designate a parameter to be autodiscovered and another parameter to be manually selected or entered.

There may be systems where autodiscovery is available. However, if some items are to be manual, then they may be all manual. If some items are autodiscovered, then all of them may be autodiscovered.

In the related art and the present system, there may be a limited number of autodiscovery items. For the related art, it may be an all or nothing autodiscovery, not selective manual setting of certain autodiscovery items. The autodiscovery and manual setup may be coded in. There may be one keystroke for the thermostat.

Figure 1:
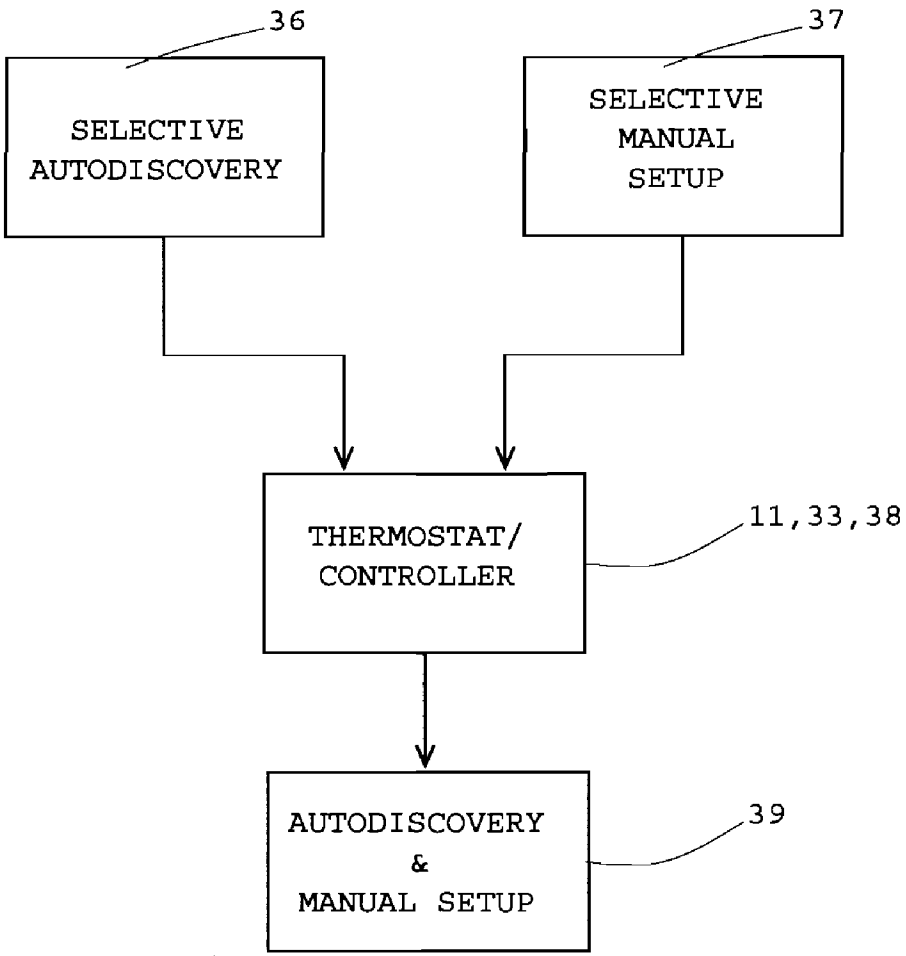
FIG. 1 is a flow diagram of a selective autodiscovery system.

The present system may have a different autodiscovery system than that of the related art. The thermostat of the present system may have several modes including autodiscovery and manual setup or input of information about a configuration of the equipment in the system. FIG. 1 shows a flow diagram of the present system. A selective autodiscovery 36 and a selective manual setup 37 may go to a thermostat or controller 38. The controller or thermostat 38 may have both the autodiscovery and manual setup 39 as selected. Each configuration (e.g., including a number of stages, cycle rates, and so on) may have an individually identifiable parameter in a setup menu, allowing an installer to manually set the value of each parameter; however, each parameter may also be set to have an "autodiscover" value. An "autodiscover" may be a default selection so that each parameter will be automatically discovered if without a manual entry or setup.

An additional part of the present system is that when a parameter is set to "autodiscover", the setup menu may show that the parameter is autodiscovered and also show what the "discovered" value is, i.e., "enabled" or "disabled". An installer may change any value, whether autodiscovered or manually entered, to another value. Further, the installer may override the automatically discovered value as necessary without affecting the autodiscovery of the other equipment, components or parameters. This characteristic of the present system is of significance.

This sensor approach may serve as an "autodiscovered" enable/disable of the control algorithm. If a sensor is installed, the feature is provided; if the sensor is not installed, the feature is not provided. In the present system, the setup menu for a sensor may have possible values of "disabled", "enabled", or "autodiscovered". If "disabled" is selected, any sensor values received by the control algorithm may be ignored, and the feature not be provided. If "enabled" is selected, then the sensor values received by the control algorithm may be accepted and the feature be provided. If, for some reason, the sensor values stop being received (e.g., the sensor is removed, is faulty or the like), a fault indication may be displayed. If "autodiscovered" is selected, then the control algorithm feature may be provided as long as sensor values continue to be received, but a fault indication should not displayed or generated when the sensor values stop.

The present invention may provide individual or selective autodiscovery and manual items. The autodiscovery of a configuration may include equipment type and existence, number of stages, blower pressure and number of speeds, manufacturer's suggestions, cycles per hour settings, rates, speeds, and so on.

In the present invention, the value that is to be autodiscovered may be changed. If the latter occurs (i.e., manual setting), the other autodiscovered items may remain as such. Anything may be set manually without disturbing the autodiscovered items.

Another part of the present system may relate to discovery of sensors. In a communicating HVAC system, sensors may be added to the system. These sensors may sense parameters, such as temperature, humidity, pressure, and so forth, and communicate the values of these parameters to a portion, e.g., a parameter controller or thermostat, of the system that implements a control algorithm. If a sensor which the control algorithm requires is not present, then the control algorithm cannot execute, and thus a result for the value of an absent parameter expected from the control algorithm would not be provided.

The autodiscovery HVAC system may tell the thermostat or controller its configuration. There may be a user interface which notes the kind of equipment that the thermostat is controlling. A communication system may be utilized. There may be relay communication with the equipment. The kind of equipment or component that is to be autodiscovered by the thermostat may include, for example, a heat pump, air conditioner, number of stages, dual fuel, and so on, via autodiscovery.

From some equipment, which is part of an HVAC system having an autodiscovery feature, there might not be autodiscovery, or information about the equipment or component which is not indicated to the thermostat, but there still may be parameter control by the thermostat or controller of the equipment. For instance, if some equipment is autodiscovered in the HVAC system and some is not, then in the latter situation, the configuration and values may be set up or entered manually. Communication of the thermostat or controller to the latter equipment may be via an equipment interface module. This module may need to know the configuration of the equipment it is talking to or providing control signals, and it may get information about the equipment from the thermostat or controller. If a certain piece of equipment is to be manually set up, then it may need to be connected to the equipment interface module for thermostat control purposes.

In an illustrative example of an HVAC system, one may have heating that is autodiscovered and air conditioning that is not. Here, the furnace may communicate with the thermostat. The furnace may tell the thermostat about itself, e.g., its configuration. Since the air conditioner may not be communicating with the thermostat, it may need an equipment interface module for the thermostat to turn it on and off via relay control of the air conditioning for temperature of a space. The thermostat might be regarded as not being compatible with the air conditioner if some of its elements are not recognized in an autodiscovery. In another instance, if there is hydronic heat, then there typically would be no fan as part of the configuration. On the other hand, there may a furnace, gas or electric, having a number of stages, and so on. There may be humidity equipment with a humidifier and dehumidifier. There may be ventilation equipment with air cleaners, UV treatment devices to purify the air, a fan with one stage (i.e., a common on/off mechanism may be just one stage), a single speed air conditioning, where a stage may be a speed of the compressor, multi-stage gas valves having, for example, three stages such as high, medium, and low. There may be cycles per hour settings. These items may be or might not be subject to autodiscovery; however, they may constitute at least part of an HVAC system configuration.

The thermostat of the present system may send out a query for configuration information. Also, the information may be automatically sent to the thermostat or controller during power up, or periodically. The system may be operated with a microprocessor as part of the thermostat or controller. For the manual setup by the installer, there may be a user interface on the processor. Also, there may be connections of the present system to other devices such as telephones, a zoning system, and so on. The system may be operated remotely via various connections.

The set autodiscover may operate on a continuous basis in the present system. Its autodiscovery may indicate the default, for example, for a gas furnace with two stages, and not necessarily a manufacturer recommended default. For instance, if there is no furnace, then there is no default because of a lack of presence of the furnace. The present system may be continuously discovered, so updates can be incorporated. This system may be applicable to home thermostats.

The system may be enabled with various programs. The following may be an illustrative instance for autodiscovery and/or manual entry of various components involving heating and cooling equipment.

SelectiveAutodiscoveryPseudocode.txt

```
Selective Autodiscovery START
    Query the HVAC equipment to determine what is installed
    Wait until no more responses occur
    IF autodiscovery of heat pump/non-heat pump system is
    enabled THEN
        IF compressor heat equipment responded THEN
        A heat pump system is present
        ELSE
            A non-heat pump system is present
        ENDIF
    ELSE
        Use the manually configured heat pump/non-heat pump value
    ENDIF
    IF autodiscovery of compressor stages are enabled THEN
        IF compressor cool equipment responded THEN
            Use the number of compressor stages from the response
        ELSE
            There are no cooling stages
        ENDIF
    ELSE
        Use the manually configured number of compressor stages
    ENDIF
    IF autodiscovery of non-compressor heating stages are enabled THEN
        IF electric heating equipment responded THEN
            Use the number of heating/aux stages from the response
        ELSEIF gas heating equipment responded THEN
            Use the number of heating/aux stages from the response
        ELSE
            There are no heating/aux stages
        ENDIF
    ELSE
        Use the manually configured number of heating/aux stages
    ENDIF
Selective Autodiscovery END
```

Figure 2:
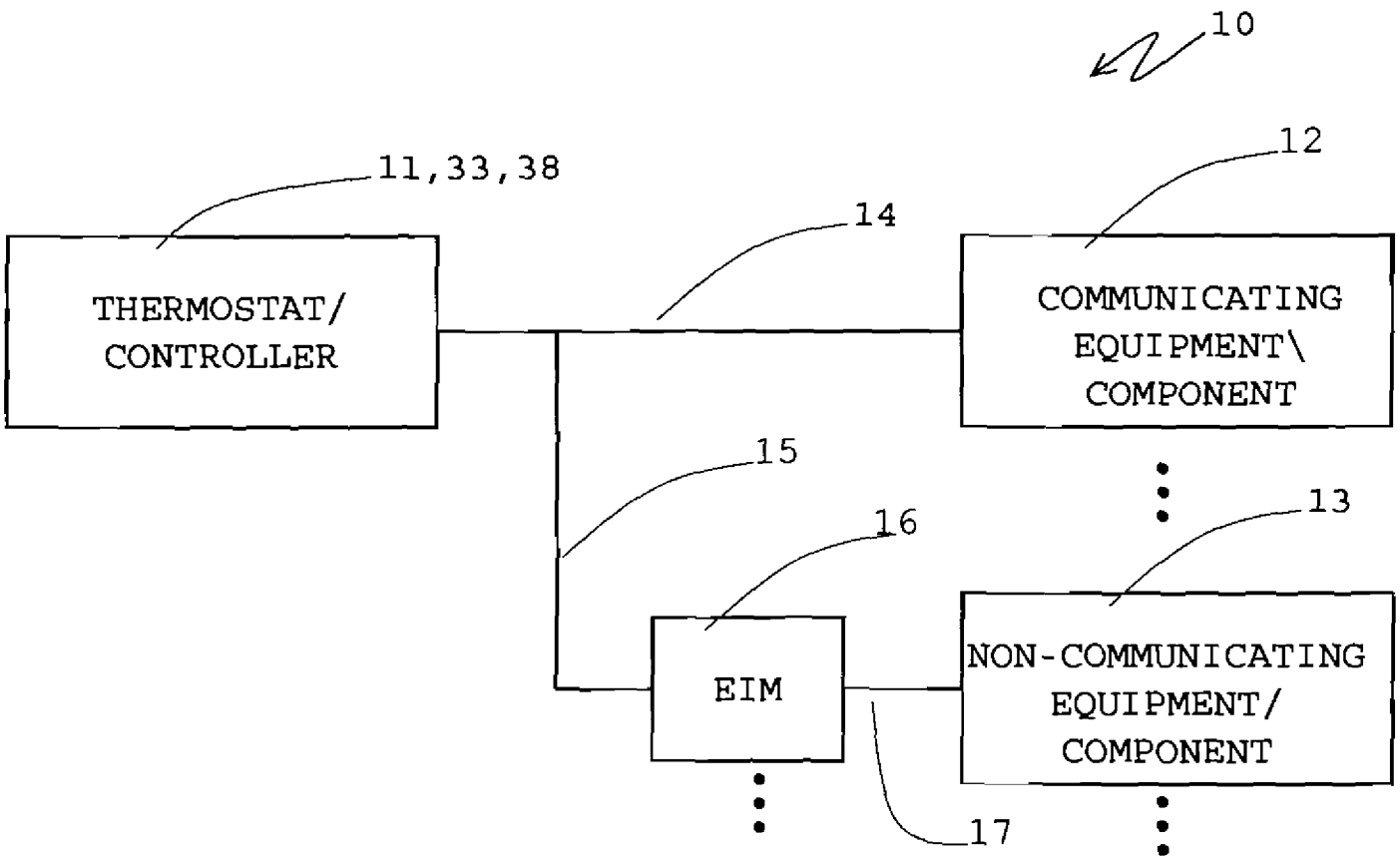
FIG. 2 is a block diagram of an HVAC autodiscovery system with autodiscovered equipment and manually inputted equipment.

FIG. 2 shows an HVAC system 10 with an illustrative example of a thermostat or controller 11, 33, 38 having an autodiscovery mode for communicating equipment 12 (e.g., furnace) and manual set-up for non-communicating equipment 13 (e.g., air conditioner). The connection between the thermostat and the communicating furnace may be effectively a direct link 14. Links 15 and 17 between the thermostat and the air conditioner may be indirect via an equipment interface module (EIM) 16. Communication between the thermostat 11 and the air conditioner 13 may be temperature control information through the equipment interface module 16 with a relay output 17 to the non-communicating air conditioner 13. Another illustrative example may include a reversal of the roles of the furnace 12 and the air conditioner 13 where the furnace is non-communicating in similar manner that the air conditioner was just noted, and that the air conditioner may be a communicating device relative to the thermostat 11. Other equipment in the HVAC system 10 may be either non-communicating in terms of a manual setup or communicating in the sense of an autodiscovery.

Figure 3:
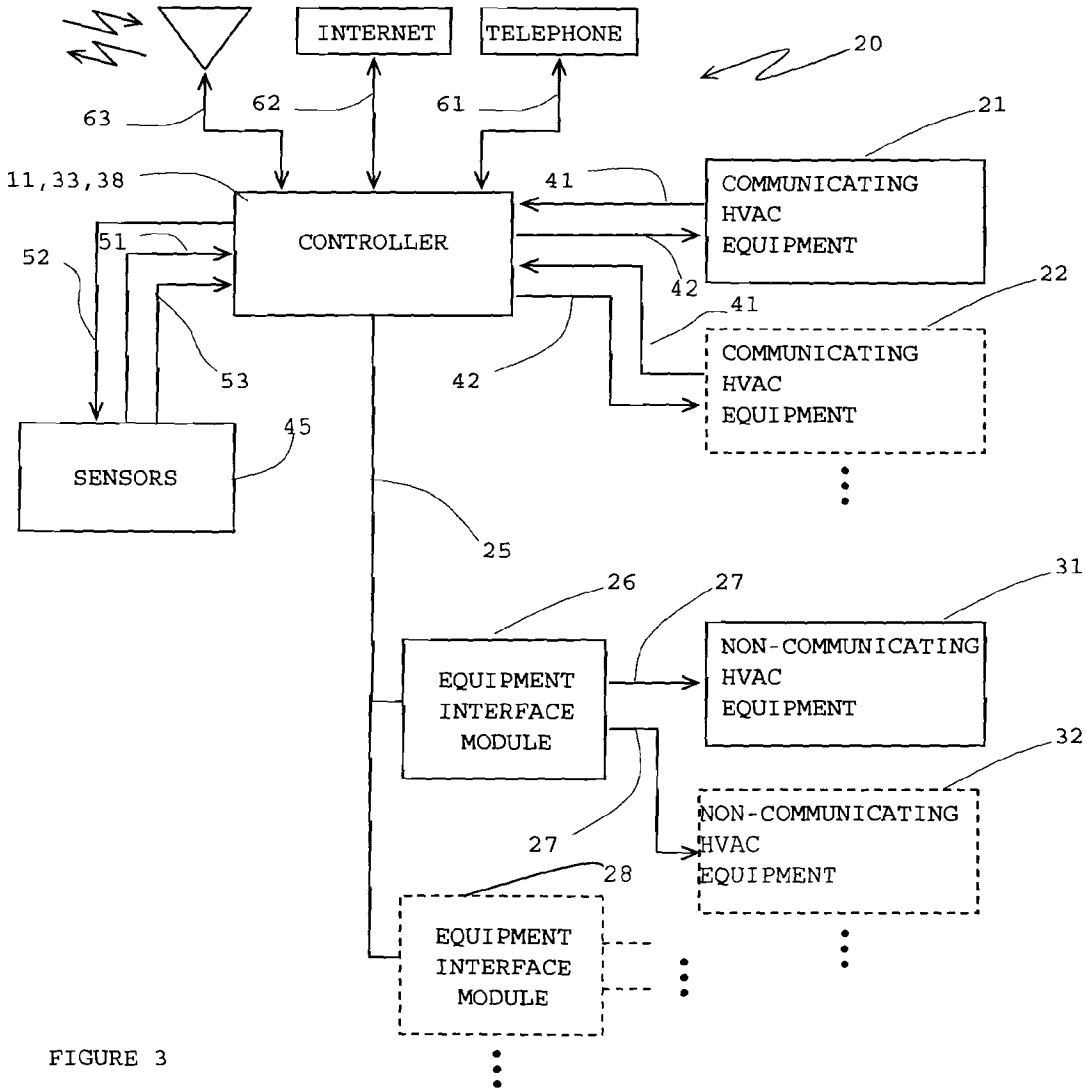
FIG. 3 is a block diagram of an HVAC autodiscovery system having communicating and non-communicating equipment.

FIG. 3 shows an illustrative example of an HVAC system 20 having one or more components or equipment subject to autodiscovery and one or more components or equipment subject to a manual set-up relative to their configuration. An example may include a communicating HVAC component or equipment 21 that may include an air conditioner, a humidifier, a furnace, a ventilator, a boiler, a dehumidifier, a dual fuel configuration, a heat pump, a blower, and/or like components. A thermostat or controller 11, 33, 38 may have a two way communication link with the equipment 21. The controller 33 may have a communication link with another a second communicating HVAC component 22 which may or may not resemble the first component 21. There may be additional such components and other kinds of communicating components or equipment connected to the controller 33.

A first link 41 of communication, as a part of the autodiscovery, from the respective component 21, 22, and so on, to the controller 33 may include configuration information such as apparatus model, apparatus serial number, heating cycles per unit time, compressor stages, cooling cycle rate, apparatus existence, blower pressure, heating stages, air purification specifications, humidifier stages, dehumidifier stages, equipment type, HVAC parameters, recommended settings, zone descriptions, sensor information, and other items.

A second link of communication 42 may include control information, for example, parameters such as temperature settings scheduled for certain time periods, from the controller 33 to the respective component 21, 22, and so on.

Also, FIG. 3 shows a relationship of a thermostat or controller 11, 33, 38 with one or more non-communicating components or equipment 31, 32, and so on. These may include non-autodiscovery components of an HVAC system 20. Communication of control of the one or more components may be manually provided to controller 33. A communication link 25 may include items such as relay control from the controller 33 to an equipment interactive module 26 (EMI). The module 26 may provide relay outputs 27 to, for example, a non-communicating HVAC component 31. The module may also provide relay outputs another component or equipment 32. The module 26 may further provide outputs to one or more additional non-communicating HVAC components or equipment, which may or may not resemble the components 31 or 32. The may be an additional equipment interactive module 28 connected to one or more non-communicating components or equipment.

Besides the communicating and non-communicating components or equipment noted herein, there may be additionally different kinds of components and equipment. Illustrative examples may include sensors 45. There may be autodiscovery information 51, such as configuration items, about the sensors 45 to the thermostat or controller 33. The controller 33 may provide certain directive or controlling information 52, such as selection or adjustment signals, to the sensors 45. Sensor data 53 may be conveyed to parameter controller 33. If there are sensors 45 which are not autodiscovered, configuration information may be manually input to one or more of these sensors 45 in a selective manner. Configuration or setting information may also be manually input for sensors 45 which are autodiscoverable. There may be an interface module, similar to interface module 26 or 28, inserted in the link between the controller 33 and sensors 45 which are not autodiscovered.

The thermostat or controller 11, 33, 38 may be remotely operated via telephonic 61, internet 62 or wireless 63 connections to respective external systems. Also, autodiscovery and manual inputs of systems 10 and 20 may be observed and/or effected via these media connections.

In the present specification, some of the matter may be of a hypothetical or prophetic nature although stated in another manner or tense.

Although the invention has been described with respect to at least one illustrative example, many variations and modifications will become apparent to those skilled in the art upon reading the present specification. It is therefore the intention that the appended claims be interpreted as broadly as possible in view of the prior art to include all such variations and modifications.

What is claimed is:

1. An autodiscovery system for an HVAC system comprising:

a controller; and at least two communicating HVAC apparatus;

a first link of communication between the controller and each of the at least two communicating HVAC apparatus for communicating configuration information from each of the at least two communicating HVAC apparatus to the controller; and a second link of communication between the controller and each of the at least two communicating HVAC apparatus for communicating control information from the controller to each of the at least two communicating HVAC apparatus; and wherein:

the controller may autodiscover the at least two communicating HVAC apparatus;

at least one apparatus of the at least two communicating HVAC apparatus may be manually set while the remaining communicating apparatus may remain autodiscovered; and the controller is a thermostat.

2. The system of claim 1, further comprising:

at least one non-communicating apparatus; and wherein the controller provides parameter control information to the at least one non-communicating apparatus.

3. The system of claim 2, further comprising:

an equipment interface module having an input connected to an output of the controller and having an output connected to an input of the at least one non-communicating apparatus; and wherein equipment control information to the at least one non-communicating apparatus is via the equipment interface module.

4. The system of claim 1, wherein an autodiscovery of a communicating apparatus is a providing of configuration information about the communicating apparatus to the controller.

5. The system of claim 4, wherein configuration information comprises one or more of the following:

apparatus model;

apparatus serial number;

heating cycle rate;

compressor stages;

cooling cycle rate;

apparatus existence;

blower pressure;

heating stages;

air purification specifications;

humidifier stages;

dehumidifier stages;

HVAC parameters;

zone descriptions; and sensor information.

6. The system of claim 1, further comprising:

sensors; and wherein some of the sensors are subject to autodiscovery.

7. The system of claim 6 wherein the sensors communicate parameters to the controller.

8. The system of claim 7, wherein the parameters comprise one or more of the following:

temperature;

humidity; and pressure.

9. The system of claim 3, wherein:

the controller is remotely operated via telephonic, internet or wireless connections; and remote operation comprises autodiscovery and manual inputs to and outputs from the controller.

10. The system of claim 7, wherein at the same time one or more parameters can be designated to be autodiscovered and one or more other parameters can be manually selected, set or entered.

11. The system of claim 1, wherein automatically discovered information can be overridden without affecting autodiscovery of other information.

12. An autodiscovery system for an HVAC system comprising:

a controller; and at least one communicating HVAC apparatus;

at least one non-communicating HVAC apparatus;

a first link of communication between the controller and the at least one communicating HVAC apparatus for communicating configuration information;

a second link of communication between the controller and the at least one communicating HVAC apparatus for communicating control information;

an equipment interface module having an input connected to an output of the controller and having an output connected to an input of the at least one non-communicating apparatus for communicating control information between the controller and the non-communicating apparatus; and wherein:

the controller may autodiscover one or more configuration information about the at least one communicating HVAC apparatus;

an autodiscovered parameter may be manually overridden without changing other autodiscovered parameters; and the controller is a thermostat.

* * * * *